US007374639B2

(12) United States Patent
Ampulski et al.

(10) Patent No.: US 7,374,639 B2
(45) Date of Patent: May 20, 2008

(54) PAPERMAKING BELT

(75) Inventors: Robert Stanley Ampulski, Fairfield, OH (US); Osman Polat, Montgomery, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 454 days.

(21) Appl. No.: 11/147,696

(22) Filed: Jun. 8, 2005

(65) Prior Publication Data

US 2006/0278298 A1 Dec. 14, 2006

(51) Int. Cl.

| | |
|---|---|
| ***D21F 1/10*** | (2006.01) |
| ***D21F 7/08*** | (2006.01) |
| ***D21F 7/12*** | (2006.01) |
| ***B32B 5/00*** | (2006.01) |

(52) U.S. Cl. ..... 162/348; 162/116; 162/306; 162/358.2; 162/900; 162/902; 162/903; 428/136; 428/196; 442/76; 442/218

(58) Field of Classification Search ..... 162/348, 162/358.2, 358.4, 900–904, 116, 117, 361, 162/362, 306; 156/459, 460; 428/195.1, 428/196, 174, 175, 156–160, 169, 179, 131, 428/133, 134–137; 442/76, 218, 220
See application file for complete search history.

(56) References Cited

U.S. PATENT DOCUMENTS

| | | | | |
|---|---|---|---|---|
| 3,175,025 | A * | 3/1965 | Geen et al. | 264/80 |
| 3,301,746 | A | 1/1967 | Sanford et al. | |
| 3,617,442 | A * | 11/1971 | Hurschman | 162/212 |
| 4,158,594 | A | 6/1979 | Becker et al. | |
| 4,208,459 | A | 6/1980 | Becker et al. | |
| 4,320,162 | A | 3/1982 | Schulz | |
| 4,483,728 | A | 11/1984 | Bauernfeind | |
| 4,514,345 | A | 4/1985 | Johnson et al. | |
| 4,528,239 | A | 7/1985 | Trokhan | |
| 4,529,480 | A | 7/1985 | Trokhan | |
| 4,546,029 | A | 10/1985 | Cancio et al. | |
| 4,637,859 | A | 1/1987 | Trokhan | |
| 4,759,967 | A | 7/1988 | Bauernfeind | |
| 4,921,034 | A | 5/1990 | Burgess et al. | |
| 5,077,116 | A * | 12/1991 | Lefkowitz | 428/141 |
| 5,098,522 | A | 3/1992 | Smurkoski et al. | |
| 5,245,025 | A | 9/1993 | Trokhan et al. | |

(Continued)

FOREIGN PATENT DOCUMENTS

WO WO 02/40769 A2 5/2002

*Primary Examiner*—Eric Hug
(74) *Attorney, Agent, or Firm*—Peter D. Meyer; Betty J. Zea; David M. Weirich

(57) ABSTRACT

A papermaking belt having a reinforcing structure and a pattern layer is disclosed. The reinforcing layer has a first layer of interwoven machine direction yarns and cross-machine direction yarns. The machine direction and cross-machine direction yarns of the first layer are interwoven in a weave. The pattern layer extends outwardly from and into the first layer. The pattern layer provides a web contacting surface facing outwardly from the first layer. The pattern layer further has at least one region having an amorphous pattern of elongate two-dimensional geometrical shapes having a longitudinal axis having an angle relative to either of the machine direction or the cross-machine direction. The amorphous pattern of two-dimensional geometrical shapes has a statically controlled degree of randomness.

20 Claims, 3 Drawing Sheets

U.S. PATENT DOCUMENTS 5,260,171 A 11/1993 Smurkoski et al.
5,275,700 A 1/1994 Trokhan
5,328,565 A 7/1994 Rasch et al.
5,334,289 A 8/1994 Trokhan et al.
5,364,504 A 11/1994 Smurkoski et al.
5,431,786 A 7/1995 Rasch et al.
5,496,624 A 3/1996 Stelljes, Jr. et al.
5,500,277 A 3/1996 Trokhan et al.
5,514,523 A 5/1996 Trokhan et al.
5,527,428 A 6/1996 Trokhan et al.
5,554,467 A 9/1996 Trokhan et al.
5,566,724 A 10/1996 Trokhan et al.
5,624,790 A 4/1997 Trokhan et al.
5,628,876 A 5/1997 Ayers et al.
5,662,758 A 9/1997 Hamilton et al.
5,679,222 A 10/1997 Rasch et al.
5,714,041 A 2/1998 Ayers et al.
5,906,710 A 5/1999 Trokhan
5,948,210 A 9/1999 Huston
5,954,097 A 9/1999 Boutilier
5,965,235 A 10/1999 McGuire et al.
5,968,029 A 10/1999 Chappell et al.
5,972,813 A 10/1999 Polat et al.
6,010,598 A 1/2000 Boutilier et al.
6,039,839 A 3/2000 Trokhan et al.
6,099,781 A 8/2000 Ampulski
6,099,940 A 8/2000 Hamilton et al.
6,110,324 A 8/2000 Trokhan et al.
6,193,918 B1 2/2001 McGuire et al.
6,254,965 B1 7/2001 McGuire et al.
6,319,455 B1 11/2001 Kauschke et al.
6,461,474 B1 * 10/2002 Lindsay et al. ..... 162/109
6,610,173 B1 8/2003 Lindsay et al.
6,733,626 B2 5/2004 Ruthven et al.
6,846,172 B2 1/2005 Vaughn et al.
6,875,315 B2 * 4/2005 Bakken et al. ..... 162/362
7,005,044 B2 * 2/2006 Kramer et al. ..... 162/362

* cited by examiner

PAPERMAKING BELT

FIELD OF THE INVENTION

The present invention relates to web making, and more particularly to belts used in papermaking. Such belts reduce non-uniform fiber distribution and/or pinholes and other irregularities indigenous to forming fibers and/or molding fibers into a three dimensional belt.

BACKGROUND OF THE INVENTION

Fibrous structures, such as paper towels, facial tissues, toilet tissues, and board, printing, and writing grades of paper, are a staple of every day life. The large demand and constant usage for such consumer products has created a demand for improved versions of these products and, likewise, improvement in the methods of their manufacture. Such cellulosic fibrous structures are manufactured by depositing an aqueous slurry from a headbox onto a Fourdrinier wire or a twin wire paper machine. Such forming wires are generally an endless belt through which initial dewatering of the slurry occurs and fiber rearrangement takes place. Frequently, fiber loss occurs due to fibers flowing through the forming wire along with the liquid carrier from the headbox.

After the initial formation of the web, which later becomes the cellulosic fibrous structure, the papermaking machine transports the web to the dry end of the machine. In the dry end of a conventional machine, a press felt compacts the web into a single region cellulosic fibrous structure prior to final drying. The final drying is usually accomplished by a heated drum, such as a Yankee drying drum, or a series of can driers for board, printing, and writing grades of paper.

One of the significant aforementioned improvements to the manufacturing process, which yields a significant improvement in the resulting consumer products, is the use of through-air drying to replace conventional press felt dewatering. In through-air drying, like press felt drying, the web begins on a forming wire that receives an aqueous slurry of less than one percent consistency (the weight percentage of fibers in the aqueous slurry) from a headbox. Initial dewatering of the slurry takes place on the forming wire, but the forming wire is not usually exposed to web consistencies of greater than 30 percent. From the forming wire, the web is transferred to an air pervious through air drying belt.

Air passes through the web and the through-air-drying belt to continue the dewatering process. The air passing the through-air-drying belt and the web is driven by vacuum transfer slots, other vacuum boxes or shoes, predryer rolls, and the like. This air molds the web to the topography of the through-air-drying belt and increases the consistency of the web. Such molding creates a more three-dimensional web, but also creates pinholes if the fibers are deflected so far in the third dimension that a breach in fiber continuity occurs.

The web is then transported to the final drying stage where the web is also imprinted. At the final drying stage, the through air drying belt transfers the web to a heated drum, such as a Yankee drying drum for final drying. During this transfer, portions of the web are densifted during imprinting to yield a multi-region structure. Many such multi-region structures have been widely accepted as preferred consumer products. An exemplary through-air-drying belt is described in U.S. Pat. No. 3,301,746.

As noted above, such through-air-drying belts used a reinforcing element to stabilize the resin. The reinforcing element also controlled the deflection of the papermaking fibers resulting from vacuum applied to the backside of the belt and airflow through the belt. Such belts use a fine mesh reinforcing element, typically having approximately fifty machine direction and fifty cross-machine direction yarns per inch. While such a fine mesh may control fiber deflection into the belt, they are unable to stand the environment of a typical papermaking machine. For example, such a belt may flexible enough so that destructive folds and creases occur. Fine yarns do not generally provide adequate seam strength and can burn at the high temperatures encountered in papermaking.

There are other drawbacks of other through-air-drying belts. For example, the continuous pattern used to produce a consumer preferred product may not allow leakage through the backside of the belt. In fact, such leakage may be minimized by the necessity to securely lock the resinous pattern onto the reinforcing structure. Unfortunately, when the lock-on of the resin to the reinforcing structure is maximized, the short rise time over which the differential pressure is applied to an individual region of fibers during the application of vacuum can pull the fibers through the reinforcing element, resulting in process hygiene problems and product acceptance problems, such as pinholes.

Standard patterned resinous through-air-drying belts maximize the projected open area, so that airflow therethrough is not reduced or unduly blocked. Patterned resinous through-air-drying belts common in the prior art use a dual layer design reinforcing element having vertically stacked warps. Generally, the wisdom has been to use relatively large diameter yarns, to increase belt life. Belt life is important not only because of the cost of the belts, but more importantly due to the expensive downtime incurred when a worn belt must be removed and a new belt installed. Unfortunately, larger diameter yarns require larger holes therebetween in order to accommodate the weave. The larger holes permit short fibers, such as Eucalyptus, to be pulled through the belt and thereby create pinholes. Unfortunately, short fibers, such as Eucalyptus, are heavily consumer preferred due to the softness they create in the resulting cellulosic fibrous structure.

Additionally, the effect of superimposing a repetitive design, such as a grid, on the same or a different design can also produce a pattern that is distinct from the components of the pattern. This is known to one of skill in the art as a Moire pattern. Such Moire patterns can detrimentally impact the appearance of products produced by such a forming structure by having unintended designs appear upon the product. These unintended Moire designs are likely to be distinct from any of the patterns used to generate the forming structure.

Accordingly, there is a need to provide a forming wire that reduces fiber loss and non-uniform fiber distribution in specific areas of the resulting product. Such a forming wire should provide a patterned resinous papermaking belt that also overcomes the prior art trade-off of belt life and reduced pinholing. Additionally, the forming wire should provide an improved patterned resinous belt having sufficient open area to efficiently use during manufacturing. Also, the papermaking belt should provide for a patterned resinous belt that produces an aesthetically acceptable consumer product comprising a cellulosic fibrous structure by eliminating Moire patterns resulting from the papermaking process.

SUMMARY OF THE INVENTION

The present invention provides a papermaking belt comprising a reinforcing structure and a pattern layer. The reinforcing structure comprises a first layer of interwoven machine direction yarns and cross-machine direction yarns. The machine direction and cross-machine direction yarns of the first layer are interwoven in a weave. The pattern layer extends outwardly from and into the first layer to provide a web contacting surface facing outwardly from said first layer. The pattern layer further comprises at least one region having an amorphous pattern of elongate two-dimensional geometrical shapes having a longitudinal axis with an angle relative to either of the machine direction or said cross-machine directions. The amorphous pattern of two-dimensional geometrical shapes has a statistically-controlled degree of randomness.

The present invention also provides a papermaking belt comprising a reinforcing structure and a pattern layer. The reinforcing structure comprises a machine facing first layer of interwoven machine direction yarns and cross machine direction yarns. The machine direction and cross-machine direction yarns of the first layer have a yarn diameter and are interwoven in a weave comprising knuckles. The knuckles define a web facing top plane. The pattern layer extends outwardly from the first layer and provides a web contacting surface facing outwardly from the top plane. The pattern layer further comprises at least one region having an amorphous pattern of elongate two-dimensional geometrical shapes having a longitudinal axis with an angle relative to either of the machine direction or cross-machine directions. The amorphous pattern of two-dimensional geometrical shapes has a statistically-controlled degree of randomness.

The present invention also provides an amorphous pattern for a pattern layer for a papermaking belt. The amorphous pattern has a machine direction and a cross-machine direction orthogonal and coplanar thereto. The amorphous pattern comprises a plurality two-dimensional geometrical shapes having a longitudinal axis with an angle relative to either of the machine direction or cross-machine directions. The two-dimensional geometrical shapes have a statistically-controlled degree of randomness.

DETAILED DESCRIPTION OF THE INVENTION

Figure 1:
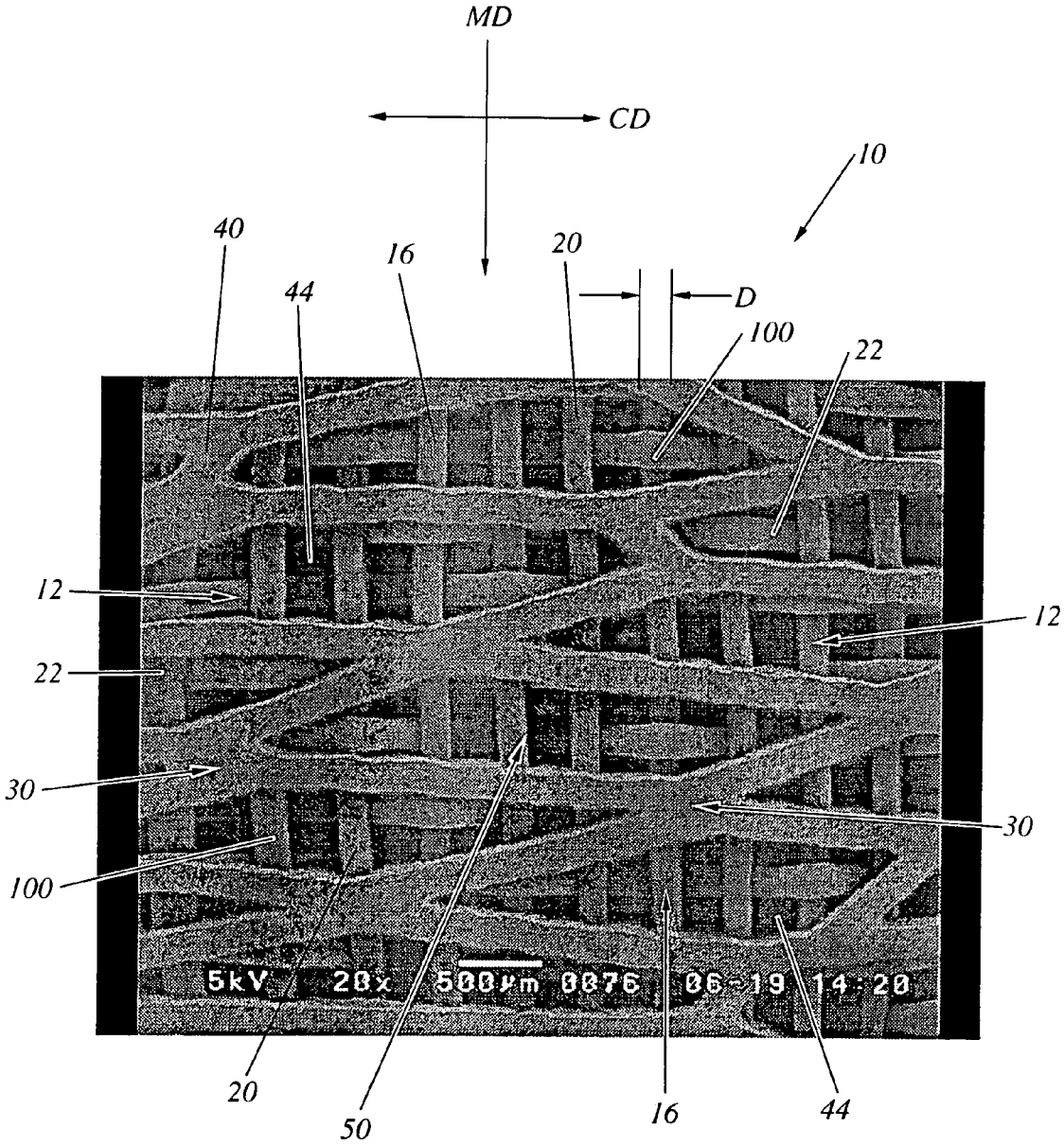
FIG. 1 is a photomicrograph of a top plan view of an exemplary belt in accordance with the present invention.
Figure 2:
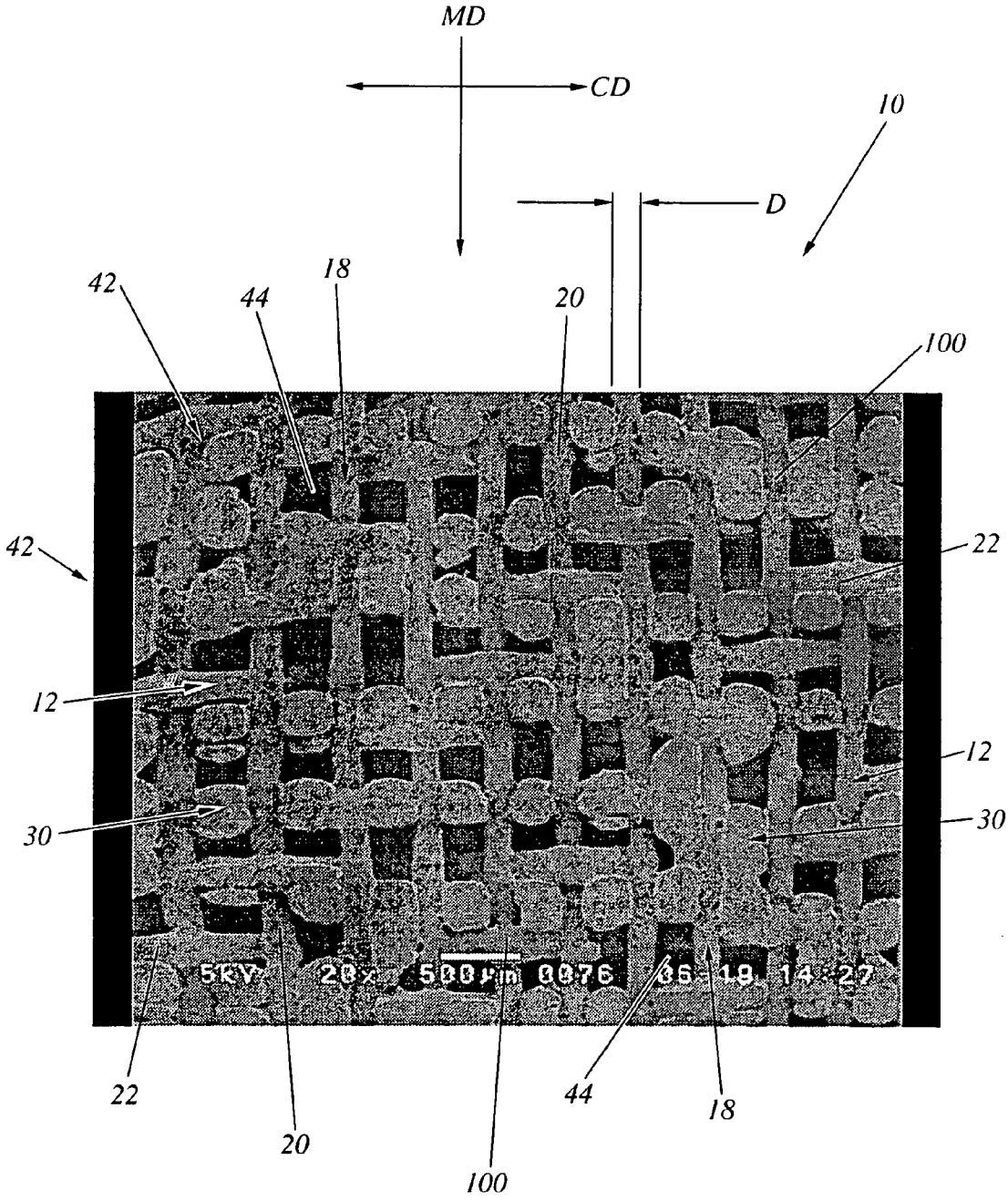
FIG. 2 is a photomicrograph of a bottom plan view of the exemplary belt of FIG. 1; and, FIG. 3 is an exemplary amorphous pattern useful for a pattern layer of the present invention.

Referring to FIGS. 1 and 2, the belt 10 of the present invention is preferably an endless belt capable of receiving cellulosic and/or starch fibers discharged from a headbox or carry a web of cellulosic, starch, and or other fibers to a drying apparatus, typically a heated drum, such as a Yankee drying drum (not shown). Thus, the endless belt 10 may either be executed as a forming wire, a press felt, a carrier fabric (belt), a transfer fabric (belt), a through-air-drying belts, dryer belts, and combinations thereof, as needed.

The papermaking belt 10 of the present invention, in any execution, comprises two primary elements: a reinforcing structure 12 and a pattern layer 30. The reinforcing structure 12 further comprises two sides, a pattern layer facing side 16 and a machine facing side 18. The reinforcing structure 12 is further comprised of interwoven machine direction yarns 20 and cross-machine direction yarns 22. As will be used herein, "yarns 100" is generic to, and inclusive of, machine direction yarns 20 and cross-machine direction yarns 22 of the reinforcing structure 12.

As will be appreciated by those of skill in the art, the reinforcing structure can comprise a second layer (not shown) as well as tie yarns (not shown) that are interwoven with the respective yarns 100 of the reinforcing structure 12. Such a structure is described in U.S. Pat. No. 5,496,624.

The second primary element of the belt 10 is the pattern layer 30. The pattern layer 30 is cast on the reinforcing structure 12 on the side opposite the machine facing side 18. The pattern layer 30 penetrates the reinforcing structure 12 and is cured into an amorphous pattern by irradiating liquid resin with actinic radiation through a binary mask having opaque sections and transparent sections.

The belt 10 has two opposed surfaces, a web contacting surface 40 disposed on the outwardly facing surface of the pattern layer 30 and an opposed backside 42. The backside 42 of the belt 10 contacts the machinery used during the papermaking operation. As would be known to those of skill in the art, such machinery (not illustrated) can include foils, vacuum boxes, pickup shoes, various rollers, and the like.

The belt 10 may further comprise conduits 44 extending from and in fluid communication with the web contacting surface 40 of the belt 10 to the backside 42 of the belt 10. The conduits 44 can allow for the deflection of the cellulosic fibers normal to the plane of the belt 10 during a papermaking operation. 5 The pattern layer 30 is preferably cast from photosensitive resin. The preferred method for applying the photosensitive resin forming the pattern layer 30 to the reinforcing structure 12 in the desired pattern is to coat the reinforcing layer with the photosensitive resin in a liquid form. Actinic radiation, having an activating wavelength matched to the cure of the resin, illuminates the liquid photosensitive resin through a mask having transparent and opaque regions. The actinic radiation passes through the transparent regions and cures the resin therebelow into the desired pattern. The liquid resin shielded by the opaque regions of the mask is not cured and is washed away, leaving the conduits 44 in the pattern layer 30.

It has been found that opaque yarns 100 may be utilized to mask the portion of the reinforcing structure 12 between such yarns 100 and the backside 42 of the belt 10 to create a backside texture as would be known to one of skill in the art. Further, one of skill in the art would understand how to incorporate such opaque yarns 100 into a reinforcing structure 12. The yarns 100 may be made opaque by coating the outsides of such yarns 10 by the addition of fillers such as carbon black or titanium dioxide, and the like.

The pattern layer 30 extends from the backside 42 of the reinforcing structure 12, outwardly from and beyond the pattern layer facing side 16 of the reinforcing structure 12. Of course, as discussed more fully below, it is not required that all of pattern layer 30 extend to the outermost plane of the backside 42 of the belt 10. Instead, some portions of the pattern layer 30 may not extend below particular yarns 100 of the reinforcing structure 12.

The term "machine direction" refers to that direction which is parallel to the principal flow of the paper web through the papermaking apparatus. The "cross-machine direction" is perpendicular and coplanar to the machine direction. A "knuckle" is the intersection of a machine direction yarn 20 and a cross-machine direction yarn 22. The "shed" is the minimum number of yarns 100 necessary to make a repeating unit in the principal direction of a yarn 100 under consideration.

The machine direction yarns 20 and cross-machine direction yarns 22 are interwoven to form reinforcing structure 12. Reinforcing structure 12 may have a one-over, one-under square weave, or any other weave desired. Preferably the machine direction yarns 20 and cross-machine direction yarns 22 comprising the reinforcing structure 12 are substantially transparent to any actinic radiation that is used to cure the pattern layer 30. Such yarns 100 are considered to be substantially transparent if actinic radiation can pass through the greatest cross-sectional dimension of the yarns 100 in a direction generally perpendicular to the plane of the belt 10 and still sufficiently cure photosensitive resin therebelow.

In accordance with the present invention, the yarns 100 of the reinforcing structure 12 may be interwoven in a weave of N over and M under, where N and M are positive integers −1, 2, 3, etc. A preferred weave of N over and M under is a weave having N equal to 1. If reinforcing structure 12 is provided with a second layer (not shown), a preferred weave is an N over, 1 under weave, etc., so long as the yarns 100 of the reinforcing structure 12 cross over the respective interwoven yarns of the second layer (not shown), such that such yarns 100 are on the top dead center longitude TDC of the reinforcing structure 12, more than on the backside of the reinforcing structure 12. For N greater than 1, preferably the N over yarns 100 are cross-machine direction yarns 22, in order to maximize fiber support.

The reinforcing structure 12 of the present invention should allow sufficient air flow perpendicular to the plane of the reinforcing structure 12. The reinforcing structure 12 preferably has an air permeability of at least 500 standard cubic feet per minute per square foot, preferably at least 1,000 standard cubic feet per minute per square foot, and more preferably at least 1,100 standard cubic feet per minute per square foot. Of course, the pattern layer 30 will reduce the air permeability of the belt 10 according to the particular pattern selected. The air permeability of a reinforcing structure 12 is measured under a tension ranging from about 15 pounds per linear inch (2.625 kN/M) to about 30 pounds per lineal inch (5.30 kN/M) using a Valmet Permeability Measuring Device from the Valmet OY Pansio Work of Finland at a differential pressure of 100 Pascals. If any portion of the reinforcing structure 12 meets the aforementioned air permeability limitations, the entire reinforcing structure 12 is considered to meet these limitations.

The pattern layer 30 of the present invention comprises a three-dimensional structure comprising a plurality of individual, three-dimensional, non-uniform, polygons 50 having an aspect ratio greater than, or equal to, 1. In a preferred embodiment the individual, three-dimensional, non-uniform, polygons 50 have an aspect ratio (width-to-height) preferably greater than 1 in a single dimension within the plane of the pattern layer 30. Preferably, the web material exhibits a non-uniform pattern of elongate polygons 50 where the longitudinal axis L of each polygon 50 is disposed generally in the cross-machine direction of the pattern layer 30 and the belt 10. However, as would be known to one of skill in the art, the longitudinal axis L of each polygon 50 can be disposed in any direction in the plane of the belt 10.

To impart minimum three-dimensional structure to the surface of the finished product produced by belt 10, pattern layer 30 should be provided with minimal thickness. In a preferred embodiment, pattern layer 30 extends above the surface of reinforcing structure 12 that is opposite the machine facing side 18 by less than about 0.003 inches (0.076 mm). A pattern layer 30 having such a thickness can result in a fabric that replaces a multi-layer woven forming fabric. This type of manufacturing can reduce loom time and cost in production. However, one of skill in the art will appreciate that for other grades and/or types of finished product, pattern layer 30 can be provided with any thickness necessary to provide the required three-dimensional structure relevant and or required for the finished product.

The thickness of the reinforcing structure 12 can be measured using an Emveco Model 210A digital micrometer made by the Emveco Company of Newburg, Oreg., or any other similar apparatus known to those of skill in the art. Such an apparatus uses a 3.0 pound per square inch (20.7 kPa) load applied through a round 0.875 inch (22.2 mm) diameter foot. The reinforcing structure 12 may be loaded up to a maximum of 20 pounds per lineal inch (3.5 kN/m) in the machine direction while tested for thickness. The reinforcing structure 12 is maintained at about 50° F. (10° C.) to about 100° F. (38° C.) during testing.

The pattern layer 30 of the present invention preferably exhibits a two-dimensional pattern of elongate three-dimensional polygons that is substantially amorphous in nature. The term "amorphous" refers to a pattern that exhibits no readily perceptible organization, or regularity, but may exhibit a perceptible orientation, of constituent elements. In such a pattern, the arrangement of one element with regard to a neighboring element bear no predictable relationship, other than orientation, to that of the next succeeding element(s). Contrastingly, an "array" refers to patterns of constituent elements that exhibit a regular, ordered grouping or arrangement. In an array pattern, the arrangement of one element with regard to a neighboring element bear a predictable relationship to that of the next succeeding element(s).

While it is presently preferred that the entire surface of the pattern layer 30 in accordance with the present invention exhibit an amorphous pattern of polygons 50, under some circumstances it may be desirable for less than the entire surface of such a pattern layer 30 to exhibit such a pattern. For example, a comparatively small portion of the pattern layer 30 may exhibit some regular pattern of polygons 50 or may in fact be free of polygons 50 so as to present a generally planar surface. In addition, when the pattern layer 30 is to be formed as a comparatively large pattern layer 30 of material and/or as an elongate belt 10, manufacturing constraints may require that the amorphous pattern itself be repeated periodically within the pattern layer 30.

In a pattern layer 30 having an amorphous pattern of polygons 50, any selection of an adjacent plurality of polygons 50 will be unique within the scope of the pattern, even though under some circumstances it is conceivable that a given individual polygon 50 may possibly not be unique within the scope of the pattern layer 30.

Three-dimensional materials having a two-dimensional pattern of polygons 50 which are substantially amorphous in nature are believed to exhibit "isomorphism". The terms "isomorphism" and "isomorphic" refer to substantial uniformity in geometrical and structural properties for a given circumscribed area wherever such an area is delineated within the pattern. By way of example, a prescribed area comprising a statistically-significant number of polygons 50 with regard to the entire amorphous pattern would yield statistically substantially equivalent values for such pattern layer 30 properties as protrusion area, number density of polygons 50, total polygon shape 50, wall length, etc., when measured with respect to direction. The term "anisomorphic" is substantially opposite in meaning from the term isomorphic. A pattern layer 30 having substantially anisomorphic properties can have properties that are different when measured along axes in different directions.

Utilization of an amorphous pattern of elongate polygons 50 can provide other advantages. For example, a three-dimensional pattern layer 30 formed from a material that is initially isotropic within the plane of the pattern layer 30 can become generally anisotropic with respect to physical pattern layer 30 properties in directions within the plane of the pattern layer 30. The term "isotropic" refers to pattern layer 30 properties that are exhibited to substantially equal degrees in all directions within the plane of the pattern layer 30. The term "anisotropic" is substantially opposite in meaning from the term isotropic. Such an amorphous pattern provides a paper structure that is amorphous in surface design. Providing a surface pattern that is amorphous is particularly useful in providing paper for printing grades. The amorphous surface does not interfere with the printed images contained thereon.

Within the preferred amorphous pattern, the polygons 50 are preferably non-uniform with regard to their size, shape, and spacing between adjacent polygon 50 centers with respect to the pattern layer 30, and generally uniform with respect to their orientation. Differences in center-to-center spacing of polygons 50 in the pattern result in the spaces between polygons 50 being located in different spatial locations with respect to the overall pattern layer 30. In a completely amorphous pattern, as would be presently preferred, the center-to-center spacing of adjacent elongate polygons 50 is random, at least within a designer-specified bounded range, so that there is an equal likelihood of the nearest neighbor to a given polygon 50 occurring at any given angular position within the plane of the pattern layer 30. Other physical geometrical characteristics of the pattern layer 30 are also preferably random, or at least non-uniform, within the boundary conditions of the pattern, such as the number of sides of the polygons 50, angles included within each polygon 50, size of the polygons 50, etc. However, while it is possible and in some circumstances desirable to have the spacing between adjacent polygons 50 be non-uniform and/or random, the selection of polygon 50 shapes which are capable of interlocking together makes a uniform spacing between adjacent polygons 50 possible.

A pattern layer 30 can be intentionally created with a plurality of amorphous areas within the same layer, even to the point of replication of the same amorphous pattern in two or more such regions. The designer may purposely separate amorphous regions with a regular, defined, non-amorphous pattern or array, or even a "blank" region with no polygons 50 at all, or any combination thereof. The formations contained within any non-amorphous area can be of any number density, height or shape. Further, the shape and dimensions of the non-amorphous region itself can be customized as desired. Additional, but non-limiting, examples of formation shapes include wedges emanating from a point, truncated wedges, polygons, circles, curvilinear shapes, and/or combinations thereof.

Additionally, a single amorphous region may fully envelop or circumscribe one or more non-amorphous areas such as a single, continuous amorphous region with non-amorphous patterns fully enclosed near the center of the web or web. Such embedded patterns can be used to communicate brand name, the manufacturer, instructions, material side or face indication, other information, or simply be decorative in nature.

Multiple non-amorphous regions may be abutted or overlapped in a substantially contiguous manner to substantially divide one amorphous pattern into multiple regions or to separate multiple amorphous regions that were never part of a greater single amorphous region beforehand. Thus, it should be apparent to one of skill in the art that the utilization of an amorphous pattern of three-dimensional polygons 50, elongate or otherwise, can enable the fabrication of pattern layers 30 having the advantages of an array pattern. This includes, for example, statistical uniformity in web properties produced from such a belt 10 on an area/location basis.

Pattern layer 30, according to the present invention, may have polygons 50 formed of virtually any three-dimensional shape and accordingly need not be all of a convex polygonal shape. However, it is presently preferred to form the polygons 50 in the shape of elongate and substantially-equal-height frustums having convex and elongate polygonal bases in the plane of one surface of the material and having interlocking, adjacent parallel sidewalls. For other applications, however, the polygons 50 need not necessarily be of polygonal shape.

As used herein, the term "polygon" and "polygonal" refers to a two-dimensional geometrical figure with three or more sides. Accordingly, triangles, quadrilaterals, pentagons, hexagons, and the like are included within the term "polygon," as would curvilinear shapes such as circles, ellipses, etc. which can be considered as having a mathematically infinite number of sides.

When designing an amorphous three-dimensional structure, the desired physical properties of the resulting structure will dictate the size, geometrical shape, and spacing of the elongate, three-dimensional topographical features as well as the choice of materials and forming techniques. For example, the bending modulus, flexibility, and/or reaction to tension of the overall belt 10 can depend upon the relative proportion of two-dimensional material between three-dimensional polygons 50.

When describing properties of three-dimensional structures of non-uniform, particularly non-circular, shapes and non-uniform spacing, it is often useful to utilize "average" quantities and/or "equivalent" quantities. For example, in terms of characterizing linear distance relationships between three-dimensional polygons 50 in a two-dimensional pattern, where spacings on a center-to-center basis or on an individual spacing basis, an "average" spacing term may be useful to characterize the resulting structure. Other quantities that could be described in terms of averages would include the proportion of surface area occupied by polygons 50, polygons 50 area, polygons 50 circumference, polygons 50 diameter, percent eccentricity, percent elongation, and the like. For other dimensions such as polygons 50 circumference and polygons 50 diameter, an approximation can be made for polygons 50 which are non-circular by constructing a hypothetical equivalent diameter as is often done in hydraulic contexts.

The three-dimensional shape of individual polygons 50 is believed to play a role in determining both the physical properties of individual polygons 50 as well as overall belt 10 properties. However, it should be noted that the foregoing discussion assumes geometric replication of three-dimensional structures from a forming structure of geometrically sound shapes. "Real world" effects such as curvature, degree of moldability, radius of corners, etc. should be taken into account with regard to ultimately exhibited physical properties. Further, the use of an interlocking network of polygons 50 can provide some sense of uniformity to the overall belt 10 structure, aiding in the control and design of overall belt 10 properties such as stretch, tensile strength, thickness, and the like, while maintaining the desired degree of amorphism in the pattern.

The use of elongate polygons having a finite number of sides in an amorphous pattern arranged in an interlocking relationship can also provide an advantage over structures or patterns employing circular, nearly-circular, and or elliptical shapes. Patterns such as arrays employing closely-packed circles or ellipses can be limited in terms of the amount of area the circle or ellipse can occupy relative to the non-circled area between adjacent circles and/or ellipses. More specifically, even patterns where adjacent circles and/or ellipses touch at their point of tangency there will still be a given amount of space "trapped" at the "corners" between consecutive points of tangency. Accordingly, amorphous patterns of circular and/or elliptical shapes can be limited in terms of how little non-circle/ellipse area can be designed into the structure. Conversely, interlocking polygonal shapes with finite numbers of sides (i.e., no shapes with curvilinear sides) can be designed so as to pack closely together and in the limiting sense can be packed such that adjacent sides of adjacent polygons can be in contact along their entire length such that there is no "trapped" free space between corners. Such patterns therefore open up the entire possible range of polygon area from nearly 0% to nearly 100%, which may be particularly desirable for certain applications where the low end of free space becomes important for functionality.

Any suitable method may be utilized to design the interlocking polygonal arrangement of polygons 50 which provides suitable design capability in terms of desirable polygons 50 size, shape, aspect ratio, taper, spacing, repeat distance, eccentricity, and the like. Even manual methods of design may be utilized. However, in accordance with the present invention, an expeditious method developed for designing and forming polygons 50 permits the precise tailoring of desirable polygons 50 size, shape, aspect ratio, taper, spacing, eccentricity, and/or elongation within an amorphous pattern, repeat distance of the amorphous pattern, and the like, as well as the continuous formation of pattern layers 30 containing such polygons 50 in an automated process.

The design of a totally random pattern can be time-consuming and complex, as would the method of manufacturing the corresponding forming structure. In accordance with the present invention, the attributes discussed supra may be obtained by designing patterns or structures where the relationship of adjacent cells or structures to one another is specified, as is the overall geometrical character of the cells or structures, but the precise size, shape, and orientation of the cells or structures is non-uniform and non-repeating. The term "non-repeating" refers to patterns or structures where an identical structure or shape is not present at any two locations within a defined area of interest. While there may be more than one polygon 50 of a given size, shape, and/or elongation within the pattern or area of interest, the presence of other polygons 50 around them of non-uniform size, shape, and/or elongation could eliminate the possibility of an identical grouping of polygons 50 being present at multiple locations. In other words, a pattern of elongate polygons 50 is non-uniform throughout the area of interest such that no grouping of polygons 50 within the overall pattern will be the same as any other like grouping of polygons 50.

It should be known to those of skill in the art that mathematical modeling can simulate real-world performance. Exemplary modeling is described in "Porous cellular ceramic membranes: a stochastic model to describe the structure of an anodic oxide membrane", by J. Broughton and G. A. Davies, Journal of Membrane Science, Vol. 106 (1995), pp. 89-101; "Computing the n-dimensional Delaunay tessellation with application to Voronoi polytopes", D. F. Watson, The Computer Journal, Vol. 24, No. 2 (1981), pp. 167-172; and, "Statistical Models to Describe the Structure of Porous Ceramic Membranes", J. F. F. Lim, X. Jia, R. Jafferali, and G. A. Davies, Separation Science and Technology, 28(1-3) (1993), pp. 821-854.

A two-dimensional polygonal pattern has been developed that is based upon a constrained Voronoi tessellation of 2-space. In such a method, nucleation points are placed in random positions in a bounded (pre-determined) plane that are equal in number to the number of polygons, elongate or otherwise, desired in the finished pattern. A computer program "grows" each point as a circle simultaneously and radially from each nucleation point at equal rates. As growth fronts from neighboring nucleation points meet, growth stops and a boundary line is formed. These boundary lines each form the edge of a polygon, with vertices formed by intersections of boundary lines. The vertices are then preferentially elongated in the direction of choice (i.e., machine direction, cross-machine direction, or any direction therebetween) by scaling with a constant.

While this theoretical background is useful in understanding how such patterns may be generated as well as the properties of such patterns, there remains the issue of performing the above numerical repetitions step-wise to propagate the nucleation points outwardly throughout the desired field of interest to completion. Accordingly, to expeditiously carry out this process, a computer program is preferably written to perform these calculations given the appropriate boundary conditions and input parameters and deliver the desired geometry.

The first step in generating a pattern for making a three-dimensional forming structure (such as belt 10) is to establish the dimensions of the desired forming structure. For example, if it is desired to construct a forming structure 8 inches wide and 10 inches long, or optionally forming a drum, belt, or plate, then an X-Y coordinate system is established with the maximum X dimension ($X_{Max}$) being 8 inches and the maximum Y dimension ($Y_{Max}$) being 10 inches (or vice-versa).

After the coordinate system and maximum dimensions are specified, the next step is to determine the number of "nucleation points" which will become the polygons (elongate or otherwise) corresponding to the number of polygons 50 desired within the defined boundaries of the forming structure. This number is an integer between 0 and infinity, and should be selected with regard to the average size, spacing, and elongation of the polygons desired in the finished pattern. Larger numbers correspond to smaller polygons, and vice-versa. A useful approach to determining the appropriate number of nucleation points or polygons is to compute the number of polygons of an artificial, hypothetical, uniform size and shape that would be required to fill the desired forming structure. Assuming common units of measurement, the forming structure area (length times width) divided by the square of the sum of the elongate polygon diameter and the spacing between polygons will yield the desired numerical value Z (rounded to the nearest integer). This formula in equation form would be:

$$Z = \frac{X_{Max} Y_{Max}}{(\text{polygon size} + \text{polygon spacing})^2}$$

Next, a suitable random number generator, known to those skilled in the art, is used. A computer program is written to run the random number generator for the desired number of iterations to generate as many random numbers as required to equal twice the desired calculated number of "nucleation points." As the numbers are generated, alternate numbers are multiplied by either the maximum X dimension or the maximum Y dimension to generate random pairs of X and Y coordinates all having X values between zero and the maximum X dimension and Y values between zero and the maximum Y dimension. These values are then stored as pairs of (X,Y) coordinates equal in number to the number of nucleation points.

The method described supra will generate a truly random pattern. This random pattern will have a large distribution of polygon sizes and shapes that may be undesirable. For example, a large distribution of polygon sizes may lead to large variations in web properties in various regions of the web and may lead to difficulties in forming the web depending upon the formation method selected. In order to provide some degree of control over the degree of randomness associated with the generation of nucleation point locations, a control factor or "constraint" is chosen and referred to hereafter as β (beta). The constraint limits the proximity of neighboring nucleation point locations through the introduction of an exclusion distance, E, which represents the minimum distance between any two adjacent nucleation points. The exclusion distance E is computed as follows:

$$E = \frac{2\beta}{\sqrt{\lambda\pi}}$$

where: λ (lambda) is the number density of points per unit area, and β ranges from 0 to 1.

To implement the control of the "degree of randomness," the first nucleation point is placed as described above. β is then selected, and E is calculated. Note that β, and thus E, remain constant throughout the placement of nucleation points. For every subsequent nucleation point (X,Y) coordinate that is generated, the distance from this point is computed to every other nucleation point that has already been placed. If this distance is less than E for any point, the newly-generated (X,Y) coordinates are deleted and a new set is generated. This process is repeated until all Z points have been successfully placed. If β=0, then the exclusion distance is zero, and the pattern will be truly random. If β=1, the exclusion distance is equal to the nearest neighbor distance for a hexagonally close-packed array. Selecting β between 0 and 1 allows control over the "degree of randomness" between the upper and lower limits of the exclusion distance.

Once the complete set of nucleation points are computed and stored, a Delaunay triangulation is performed as the precursor step to generating the finished polygonal pattern. The use of a Delaunay triangulation provides a mathematically equivalent alternative to iteratively "growing" the polygons from the nucleation points simultaneously as circles, as described supra. Performing the triangulation generates sets of three nucleation points forming triangles, such that a circle constructed to pass through those three points will not include any other nucleation points within the circle. To perform the Delaunay triangulation, a computer program assembles every possible combination of three nucleation points, with each nucleation point being assigned a unique number (integer) for identification purposes. The radius and center point coordinates are then calculated for a circle passing through each set of three triangularly arranged points. The coordinate locations of each nucleation point not used to define the particular triangle are then compared with the coordinates of the circle (radius and center point) to determine whether any of the other nucleation points fall within the circle of the three points of interest. If the constructed circle for those three points passes the test (no other nucleation points falling within the circle), then the three point numbers, their X and Y coordinates, the radius of the circle, and the X and Y coordinates of the circle center are stored. If the constructed circle for those three points fails the test, no results are saved and the calculation progresses to the next set of three points.

Once the Delaunay triangulation has been completed, a Voronoi tessellation of 2-space generates the finished polygons. To accomplish the tessellation, each nucleation point saved as a vertex of a Delaunay triangle forms the center of a polygon. The outline of the polygon is then constructed by sequentially connecting the center points of the circumscribed circles of each of the Delaunay triangles, including the vertex, sequentially in clockwise fashion. Saving these circle center points in a repetitive order such as clockwise enables the coordinates of the vertices of each polygon to be stored sequentially throughout the field of nucleation points. In generating the polygons, a comparison is made such that any triangle vertices at the boundaries of the pattern are omitted from the calculation since they will not define a complete polygon. Once the vertices are generated, they are then preferentially elongated by scaling with a constant based on the desired aspect ratio. Assuming conservation of 2-space area, the y-coordinate vertices can be scaled by the desired aspect ratio and the x-coordinate can be scaled by one over the desired aspect ratio.

Once a finished pattern of interlocking elongate polygonal two-dimensional shapes is generated, the network of interlocking shapes is utilized as the design for the pattern layer 30 with the pattern defining the shapes of the polygons 50. In order to accomplish this formation of polygons 50 from an initially planar web of starting material, a suitable forming structure comprising a negative of the desired finished three-dimensional structure is created with which the starting material is caused to conform by exerting suitable forces sufficient to permanently deform the starting material.

From the completed data file of polygon vertex coordinates, a physical output such as a line drawing may be made of the finished pattern of polygons 50. This pattern may be utilized in conventional fashion as the input pattern for a metal screen etching process to form a three-dimensional forming structure suitable for forming the materials of the present invention. If a greater spacing between the polygons 50 is desired, a computer program can be written to add one or more parallel lines to each polygon side to increase their width (and hence decrease the size of the polygons 50 a corresponding amount).

Preferably, the computer program described above provides a computer graphic (.TIFF) file for output. From this data file, a photographic negative can be used to provide a mask layer that is used to etch impressions into a material that will correspond to the desired frustum polygonal shapes in the finished web of material. This mask layer can alternatively be used to provide the desired pattern for producing a resinous belt as described supra.

Without desiring to be bound by theory, it is believed that a predictable level of consistency may be designed into the patterns generated according to the preferred method of the present invention even though amorphousness within the pattern is preserved.

Figure 3:
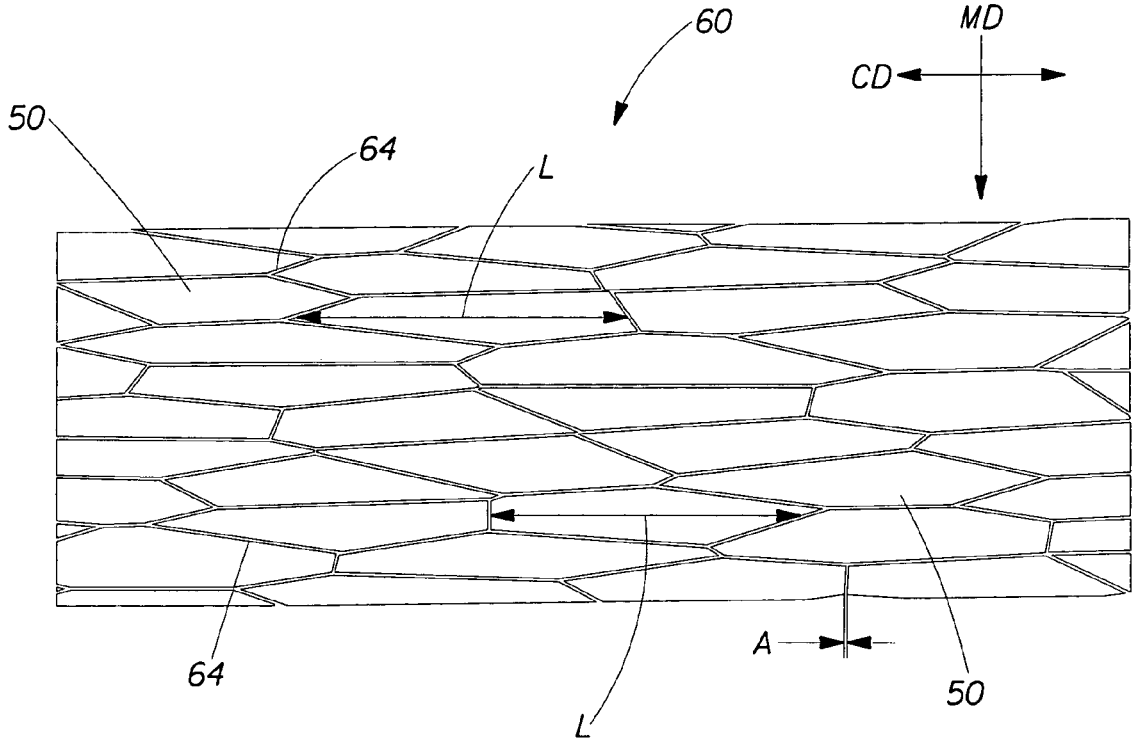

Referring to FIG. 3, there is shown a plan view of a representative two dimensional pattern for the production of a three-dimensional amorphous pattern 60 for a pattern layer 30 of the present invention. The amorphous pattern 60 has a plurality of elongate, non-uniformly shaped and sized, polygons 50, surrounded by spaces or valleys 64 therebetween, which are preferably interconnected to form a continuous network of spaces within the amorphous pattern 60. FIG. 3 also shows a dimension A, which represents the width of spaces 64, measured as the substantially perpendicular distance between adjacent, substantially parallel walls at the base of the polygons 50. In a preferred embodiment, the width of spaces 64 is preferably substantially constant throughout the pattern of polygons 50 forming amorphous pattern 60.

In a preferred embodiment, the polygons 50 are provided with an aspect ratio greater than, or equal to, 1, more preferably greater than one, and even more preferably ranging from 1 to 10, in a single dimension within the plane of the pattern layer 30. In another preferred embodiment, elongate polygons 50 are preferably provided with an average cross-machine direction base diameter of about 0.005 inches (0.013 cm) to about 0.12 inches (0.30 cm). In a preferred embodiment the number of polygons 50 per square inch range from 7 to 5000 polygons 50 per square inch, more preferably 50 to 2500 polygons 50 per square inch, and even more preferably 75 to 1500 polygons 50 per square inch. The polygons 50 occupy from about from about 10% to about 90%, more preferably from about 60% to about 80% of the available area of pattern layer 30.

Referring again to FIG. 3, polygons 50 preferably have a convex polygonal base shape, the formation of which is described infra. By convex polygonal shape, it is meant that the bases of the polygons 50 have multiple (three or more) linear sides. Of course, alternative base shapes are equally useful. The elongate polygons 50 preferably interlock in the plane of the lower or female surface, as in a tessellation, to provide constant width spacing between them. The width A of spaces 64 may be selected depending upon the amount of space desired between adjacent polygons 50. In a preferred embodiment, width A is always less than the minimum polygons 50 dimension of any of plurality of polygons 50.

All documents cited in the Detailed Description of the Invention are, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A papermaking belt comprising:

a reinforcing structure comprising a first layer of interwoven machine direction yarns and cross-machine direction yams, said machine direction and cross-machine direction yarns of said first layer being interwoven in a weave; and, a pattern layer extending outwardly from and into said first layer, wherein said pattern layer provides a web contacting surface facing outwardly from said first layer, said pattern layer further comprising at least one region having an amorphous pattern of elongate two-dimensional geometrical shapes having a longitudinal axis having an angle relative to either of said machine direction or said cross-machine direction, said two-dimensional geometrical shapes having an aspect ratio greater than 1 in said cross-machine direction, said amorphous pattern of two-dimensional geometrical shapes having a statistically controlled degree of randomness.

2. The papermaking belt according to claim 1 wherein said two-dimensional geometrical shapes of said elongate amorphous pattern comprise interlocking convex polygons each having a finite number of substantially linear sides with facing sides of adjacent polygons being substantially parallel.

3. The papermaking belt according to claim 2 wherein said two-dimensional geometrical shapes have an aspect ratio greater than 1 in a single dimension within the plane of said pattern layer.

4. The papermaking belt according to claim 1 wherein said two-dimensional geometrical shapes have a number of two-dimensional geometrical shapes per square inch ranging from 7 to 5000.

5. The papermaking belt according to claim 1 wherein said amorphous pattern includes a plurality of different two-dimensional geometrical shapes.

6. The papermaking belt according to claim 1 wherein any single two-dimensional geometrical shape within said amorphous pattern has an equal probability of the nearest neighboring two-dimensional geometrical shape being located at any angular orientation with the plane of said pattern layer.

7. The papermaking belt according to claim 1 wherein said machine direction yarns and said cross-machine direction yarns of said first layer are generally orthogonal and thereby form knuckles.

8. The papermaking belt according to claim 7 wherein said yarns of said first layer are interwoven in an N over, M under yarn weave wherein N and M are positive integers.

9. The papermaking belt according to claim 8 wherein said N over yarns are said cross machine direction yarns.

10. The papermaking belt according to claim 8 wherein N equals 1.

11. The papermaking belt according to claim 1 wherein said papermaking belt is selected from the group consisting of forming wires, press felts, transfer belts, carrier belts, through-air-drying belts, dryer belts, and combinations thereof.

12. The papermaking belt according to claim 1 wherein said papermaking belt comprises a portion of a papermaking process.

13. A papermaking belt comprising:

a reinforcing structure comprising a machine facing first layer of interwoven machine direction yarns and cross machine direction yarns, said machine direction and cross-machine direction yarns of said first layer having a yarn diameter and being interwoven in a weave comprising knuckles, said knuckles defining a web facing top plane; and, a pattern layer extending outwardly from said first layer, wherein said pattern layer provides a web contacting surface facing outwardly from said top plane, said pattern layer further comprising at least one region having an amorphous pattern of elongate two-dimensional geometrical shapes having a longitudinal axis having an angle relative to either of said machine direction or said cross-machine direction, said two-dimensional geometrical shapes have an aspect ratio greater than 1 in said cross-machine direction, said amorphous pattern of two-dimensional geometrical shapes having a statistically controlled degree of randomness.

14. The papermaking belt according to claim 13 wherein said two-dimensional geometrical shapes have an aspect ratio greater than 1 in a single dimension within the plane of said pattern layer.

15. The papermaking belt according to claim 13 wherein any single two-dimensional geometrical shape within said amorphous pattern has an equal probability of the nearest neighboring two-dimensional geometrical shape being located at any angular orientation with the plane of said pattern layer.

16. The papermaking belt according to claim 13 wherein said yarns of said first layer are interwoven in an N over, M under weave wherein N and M are positive integers.

17. The papermaking belt according to claim 16 wherein N equals 1.

18. A papermaking belt comprising:

a reinforcing structure comprising a first layer of interwoven machine direction yarns and cross-machine direction yams, said machine direction and cross-machine direction yarns of said first layer being interwoven in a weave; and, a pattern layer extending outwardly from and into said first layer, wherein said pattern layer provides a web contacting surface facing outwardly from said first layer, said pattern layer further comprising at least one region having an amorphous pattern of elongate two-dimensional geometrical shapes having a longitudinal axis having an angle relative to either of said machine direction or said cross-machine direction, said two-dimensional geometrical shapes having a number of two-dimensional geometrical shapes per square inch ranging from 7 to 5000, said amorphous pattern of two-dimensional geometrical shapes having a statistically controlled degree of randomness.

19. The papermaking belt according to claim 18 wherein said amorphous pattern includes a plurality of different two-dimensional geometrical shapes.

20. The papermaking belt according to claim 18 wherein said two-dimensional geometrical shapes of said elongate amorphous pattern comprise interlocking convex polygons each having a finite number of substantially linear sides with facing sides of adjacent polygons being substantially parallel.

* * * * *